US009617054B2

(12) United States Patent
Niggemyer

(10) Patent No.: US 9,617,054 B2
(45) Date of Patent: Apr. 11, 2017

(54) DUAL THREAD NOZZLE AND CAP ASSEMBLY FOR DISPENSING POUCH

(71) Applicant: Decko Products, Inc., Sandusky, OH (US)

(72) Inventor: F. William Niggemyer, Fremont, OH (US)

(73) Assignee: DECKO PRODUCTS, INC., Sandusky, OH (US)

( * ) Notice: Subject to any disclaimer, the term of this patent is extended or adjusted under 35 U.S.C. 154(b) by 0 days.

(21) Appl. No.: 14/737,703

(22) Filed: Jun. 12, 2015

(65) Prior Publication Data

US 2015/0360830 A1 Dec. 17, 2015

Related U.S. Application Data

(60) Provisional application No. 62/011,603, filed on Jun. 13, 2014.

(51) Int. Cl.
*B65D 47/12* (2006.01)
*B65D 75/58* (2006.01)

(52) U.S. Cl.
CPC ..... *B65D 75/5883* (2013.01)

(58) Field of Classification Search
CPC ..... B65D 75/5883
USPC .. 222/566, 546, 554, 562, 563, 92, 173, 105
See application file for complete search history.

(56) References Cited

U.S. PATENT DOCUMENTS

| | | | | |
|---|---|---|---|---|
| 279,555 | A | 6/1883 | Fish | |
| 560,719 | A | 5/1896 | Hueg | |
| 2,337,616 | A | 12/1943 | McManus et al. | |
| 2,441,649 | A | 5/1948 | Sprague | |
| 2,539,944 | A | 1/1951 | Bury | |
| 2,620,756 | A * | 12/1952 | Krens | A21C 15/005 222/94 |
| 2,845,645 | A | 8/1958 | Wishnefsky et al. | |
| 3,265,233 | A * | 8/1966 | Tuuri | B65D 50/067 215/213 |
| 3,801,247 | A | 4/1974 | Parrish et al. | |
| 3,827,593 | A * | 8/1974 | Kramb | B65D 50/063 215/208 |
| 4,362,250 | A | 12/1982 | Cottingham | |
| 4,760,941 | A | 8/1988 | Salmon et al. | |
| 5,248,071 | A | 9/1993 | Ray | |
| 5,758,787 | A | 6/1998 | Sheu | |
| 6,270,277 | B1 | 8/2001 | Ogino et al. | |
| 6,592,282 | B2 | 7/2003 | Fontanet et al. | |
| 6,981,614 | B2 | 1/2006 | Niggemyer | |
| 7,337,923 | B2 | 3/2008 | Niggemyer et al. | |
| 7,762,439 | B2 | 7/2010 | Niggemyer et al. | |
| 2002/0076256 | A1 | 6/2002 | Gueret | |

(Continued)

FOREIGN PATENT DOCUMENTS

| | | | |
|---|---|---|---|
| FR | 2636926 A1 | 3/1990 | |
| GB | 2224309 A * | 5/1990 | B65D 47/0814 |

*Primary Examiner* — Donnell Long

(74) *Attorney, Agent, or Firm* — Fraser Clemens Martin & Miller LLC; James D. Miller

(57) ABSTRACT

A nozzle and cap assembly for a dispensing pouch includes a hollow unitary nozzle terminating in a rim. The nozzle including a first exterior threaded section and a second exterior threaded section having a different diameter than a diameter of the first exterior threaded section. A cap receives the nozzle and has an inner surface interfacing with the rim to seal the nozzle.

18 Claims, 3 Drawing Sheets

(56) References Cited

U.S. PATENT DOCUMENTS

| | | | | |
|---|---|---|---|---|
| 2003/0205584 | A1 | 11/2003 | Niggemyer | |
| 2004/0079766 | A1 * | 4/2004 | Kokubo ..... | B65D 47/0838 222/212 |

* cited by examiner

DUAL THREAD NOZZLE AND CAP ASSEMBLY FOR DISPENSING POUCH

CROSS-REFERENCE TO RELATED APPLICATION

This application claims priority to U.S. Provisional Patent Application Ser. No. 62/011,603 filed Jun. 13, 2014, hereby incorporated herein by reference in its entirety.

FIELD

The present technology relates to a nozzle and cap assembly and more particularly to a dual thread nozzle and cap assembly for a pouch that dispenses a confectionery used in the decoration of cakes and cookies, for example.

INTRODUCTION

The application of flowable confectionery or icing to the top and sides of an iced cake or other pastry is well known in the art. Typically, the confectionery is sufficiently viscous to maintain a shape and is resistant to excessive flow or slumping after being extruded or dispensed from an associated bag or dispensing pouch. Some types of flowable confectionery may tend to surface harden by reason of water evaporation after being dispensed from the pouch. Accordingly, it is desirable that the pouch and the dispensing system be substantially leak-proof and air tight to prevent evaporation of water and the resultant hardening of the contents prior to application. Certain flexible and collapsible dispensing pouches utilized for decorating cakes and other pastries employ a dispensing nozzle, through which a flowable confectionery such as cake icing may be extruded. An example of a dispensing system is shown and described in U.S. Pat. No. 6,981,614, the contents of which are hereby incorporated herein by reference.

Dispensing pouches are usually adapted to receive a decorating tip either alone or with a cooperating collar or compression ring that engages a threaded portion of the dispensing nozzle to hold the decorating tip in place. The flowable confection is caused to be extruded through the decorating tip by collapsing the dispensing pouch and applying pressure thereto. The shape of the free end of the decorating tip determines the final shape of the extruded confection.

In order to create extruded designs of a different type or size, use of a different decorating tip is required. This may require that a different nozzle tip assembly be used, thereby exposing the confectionery stored in the dispensing pouch to air, resulting in drying and surface hardening. Certain nozzle and cap assemblies accept decorating tips of different sizes and shapes to allow interchanging of the decorating tips such as shown and described in U.S. Pat. No. 7,762,439, the contents of which are hereby incorporated herein by reference, and U.S. Pat. No. 7,337,923, the contents of which are hereby incorporated herein by reference. However, the nozzle and cap may not effectively cooperate with each other to maintain a hermetically sealed nozzle. For example, as assembled, a space typically exists between the nozzle opening and the cap to militate against damage to the nozzle opening. Therefore, confectionery can leak intermediate the nozzle and cap and succumb to hardening and/or the confectionery within the dispensing pouch or nozzle can harden and cause clogging of the nozzle and decorating tips. Additionally, some nozzle and cap assemblies require multiple parts, additional molded features, and components, which undesirably leads to higher manufacturing costs.

Therefore, it would be desirable to improve nozzle and cap assemblies for a dispensing pouch to facilitate effective sealing and militate against a complexity and cost of manufacturing.

SUMMARY OF THE INVENTION

In accordance and attuned with the instant disclosure, an improvement of a nozzle and cap assembly for a dispensing pouch to facilitate effective sealing and militate against a complexity and cost of manufacturing.

According to an embodiment of the disclosure, a nozzle and cap assembly is disclosed. The nozzle and cap assembly includes a hollow unitary nozzle terminating in a rim. The nozzle including a first exterior threaded section and a second exterior threaded section having a different diameter from a diameter of the first exterior threaded section. A cap receives the nozzle and has an inner surface interfacing with the rim to seal the nozzle.

According to another embodiment of the disclosure, a nozzle and cap assembly for a dispensing pouch is disclosed. The nozzle and cap assembly includes a nozzle including a first end, a second end, and an aperture extending therethrough. The second end has a first threaded portion and a second threaded portion formed on an outer surface thereof. The first threaded portion has a diameter greater than a diameter of the second threaded portion. The nozzle and cap assembly further includes a cap having an open end, a closed end, a first wall disposed adjacent the closed end and releasably engaging with the first threaded portion, and a second wall disposed adjacent the open end and releasably engaging with the second threaded portion. An inner surface of the closed end covers the aperture of the nozzle.

According to yet another embodiment of the invention, a dispensing pouch assembly is disclosed. The dispensing pouch assembly including a dispensing pouch having an opening and a hollow unitary nozzle in fluid communication with the opening of the dispensing pouch. The nozzle including a first end and a second end. The first end joined with the dispensing pouch. The second end terminating in a substantially planar rim and having a first exterior threaded section and a second exterior threaded section. The first exterior threaded section has a different diameter from a diameter of the first exterior threaded section. A cap receives the nozzle and has an inner surface interfacing with the substantially planar rim to seal the nozzle.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The above, as well as other objects and advantages of the invention, will become readily apparent to those skilled in the art from the following detailed description of an embodiment of the invention when considered in the light of the accompanying figures, in which.

DETAILED DESCRIPTION

The following detailed description and appended drawings describe and illustrate various embodiments of the invention. The description and drawings serve to enable one skilled in the art to make and use the invention, and are not intended to limit the scope of the invention in any manner.

In FIGS. 1-4, a nozzle and cap assembly 10 adapted to be joined with a container is shown. The nozzle and cap assembly 10 includes a unitary hollow nozzle 12 and a cap 14. The cap 14 cooperating with the nozzle 12 to seal the nozzle 12.

Figure 6:
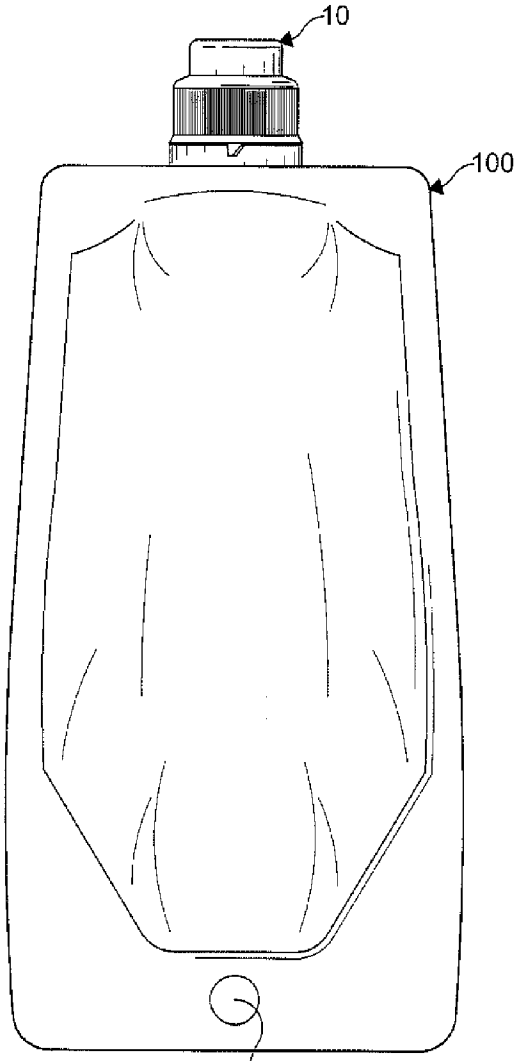
FIG. 6 illustrates a front elevational view of the nozzle and cap assembly of FIG. 1 coupled to an associated dispensing pouch.

The nozzle 12 includes a radially outwardly extending collar 16 formed at a first end 18 of the nozzle 12 and adapted to be joined with the container, such as a dispensing pouch 100 as shown in FIG. 6. The nozzle 12 further includes a first threaded section 22 and a second threaded section 24 formed at a second end 20 thereof. The threaded sections 22, 24 are formed on an outer surface of an annular wall 28 of the nozzle 12 and are concentrically aligned with each other. A diameter of the first threaded section 22 is less than a diameter of the second threaded section 24. In certain embodiments, a flange 26 is disposed intermediate the second threaded section 24 and the collar 16. The annular wall 28 defines an aperture 30 that extends through the nozzle 12 from the second end 20 to the first end 18 thereof. The annular wall 28 terminates at a substantially planar rim 31 formed at the second end 20 of the nozzle 12.

The cap 14 has an open end 34, a closed end 36, a first annular wall 40 disposed adjacent the closed end 36, and a second annular wall 42 disposed adjacent the open end 34. The closed end 36, the first annular wall 40, and the second annular wall 42 define a cavity 38 configured to receive the first threaded section 22 and the second threaded section 24 of the nozzle 12. In the embodiment shown in FIG. 4, threaded portions 44 are formed on the inner surface of the first annular wall 40 and the inner surface of the second annular wall 42. The threaded portions 44 are configured to correspondingly releasably engage with the first threaded section 22 and the second threaded section 24 of the nozzle 12 to couple the cap 14 to the nozzle 12. A diameter of the first annular wall 40 has a diameter substantially corresponding to a diameter of the first threaded section 22 and a diameter of the second annular wall 42 has a diameter substantially equal to the second threaded section 22. Additionally, a height of the first annular wall 40 has a height substantially corresponding to a height of the first threaded section 22 and a height of the second annular wall 42 has a height substantially equal to a height of second threaded section 22. It is understood that the cap 14 can be coupled to the nozzle 12 by other means as desired such as with an interference fit, for example.

The nozzle and cap assembly 10 further includes a ring 32 having notches 33 formed therein disposed intermediate the open end 34 of the cap 14 and the collar 16 of the nozzle 12. The ring 32 is configured as a tamper evident indicator. The ring 32 may be coupled to the cap 14 by frangible elements (not shown). The ring 32 is positioned about the flange 26 and secured thereto by a snap fit, friction fit, or other similar coupling means. In certain embodiments, tabs 48 extend outwardly from the cap 14 and are adapted to engage with the notches 33 of the ring 32 to facilitate stability and to maintain the frangible elements in position during an initial assembly of the nozzle and cap assembly 10.

Figure 4:
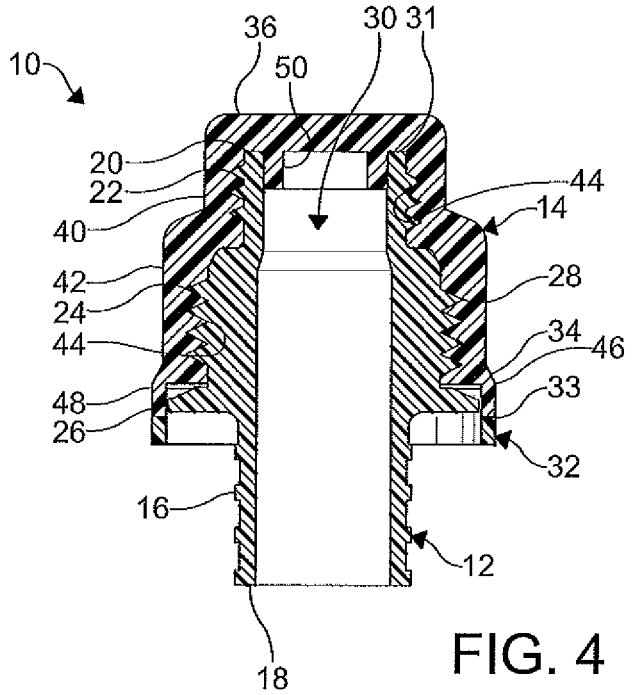
FIG. 4 illustrates a cross-sectional view of the nozzle and cap assembly of FIG. 3, taken along the line 4-4.

The nozzle and cap assembly 10 can further include sealing features to facilitate sealing of the nozzle 12. For example, in certain embodiments, the cap 14 further includes a lip 46 formed on the second wall 42 at the open end 34 thereof. The lip 46 is adapted to align with the ring 32. In another example, as shown in FIG. 4, an annular protrusion 50 is formed on the inner surface of the cap 14 at the closed end 36 thereof. The annular protrusion 50 has an outer diameter substantially equal to a diameter of the aperture 30 of the nozzle 12. In yet a further example, surface roughening means 52 can be formed on an outer surface of the cap 14 to facilitate gripping the cap 14 such as grooves or protrusions, for example.

During assembly, the cap 14 receives the nozzle 12. The threaded portions 44 of the cap 14 threadingly engage with the first threaded section 22 and the second threaded section 24 of the nozzle 12. When the cap 14 is engaged with the nozzle 12, the rim 31 interfaces the inner surface of the cap 14 to facilitate hermetically sealing the aperture 30 of the nozzle 12. The annular protrusion 50 cooperates with the inner wall of the cap 14 to form a channel. The channel is configured to receive and guide the rim 32 of the nozzle 12 to interface with the inner surface of the cap 14. The annular protrusion 50 extends into the aperture 30 and interfaces the inner surface of the annular wall 28 of the nozzle 12. In certain embodiments, during an initial assembly, prior to the cap receiving the nozzle 12, the ring 32 is coupled to the cap 14 via the frangible elements, wherein the tabs 48 of the cap 14 engage with the notches 33 of the ring 32. Thereafter, the cap 14 and ring 32 are then positioned over the nozzle so that the ring 32 is positioned about the flange 26 of the nozzle 12.

Figure 2:
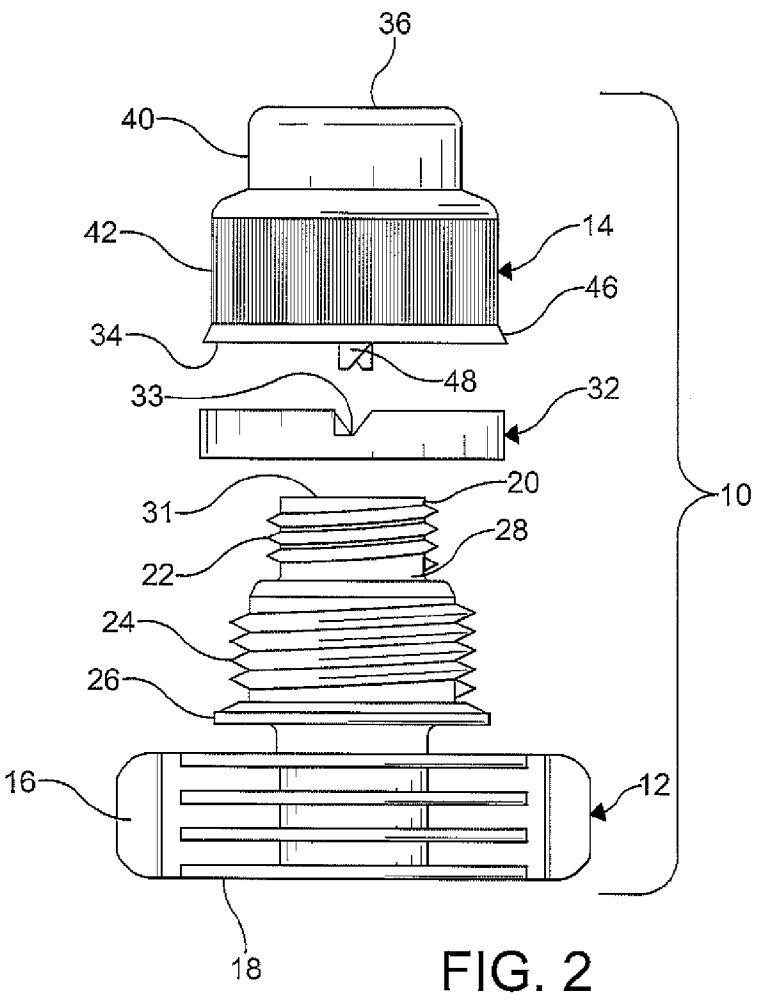
FIG. 2 illustrates an exploded front elevational view of the nozzle and cap assembly of FIG. 1.
Figure 1:
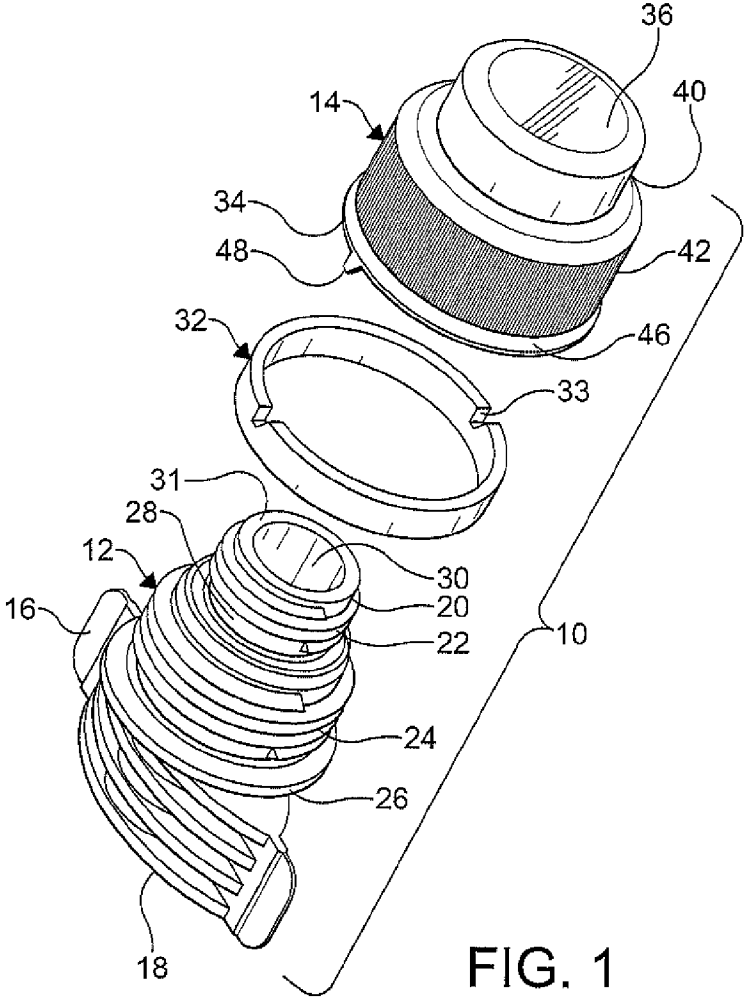
FIG. 1 illustrates an exploded top perspective view of a nozzle and cap assembly according to an embodiment of the invention.
Figure 3:
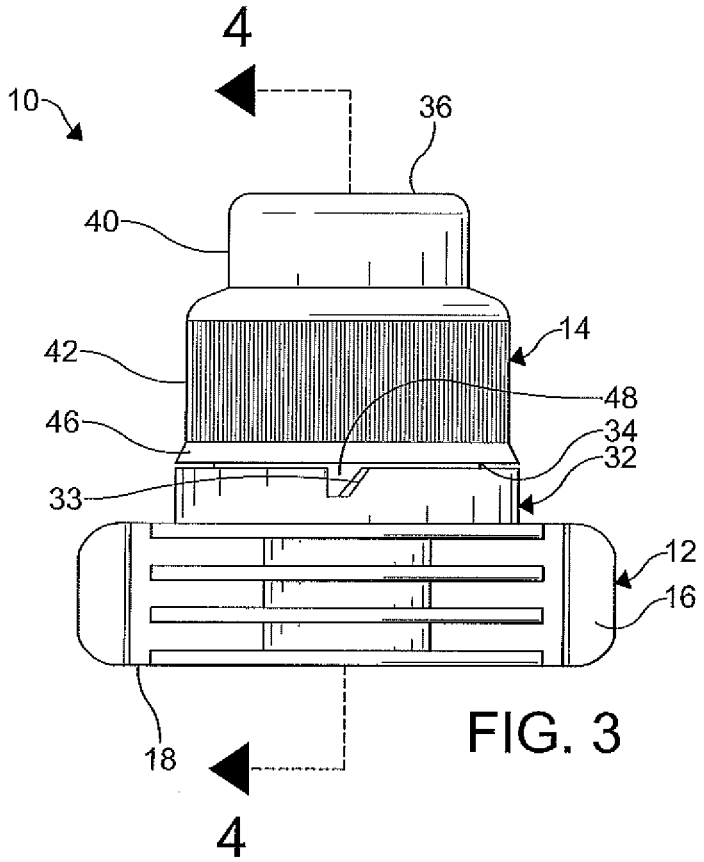
FIG. 3 illustrates an assembled front elevational view of the nozzle and cap assembly of FIG. 1.
Figure 5:
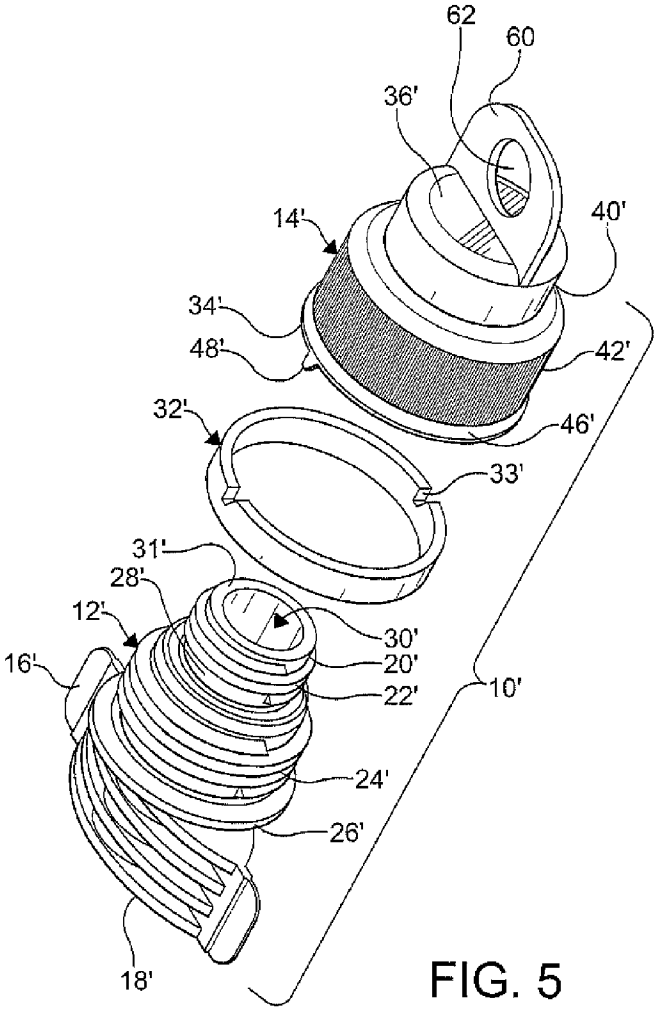
FIG. 5 illustrates an exploded top perspective view of a nozzle and cap assembly according to another embodiment of the invention.

In FIG. 5, a nozzle and cap assembly 10' according to another embodiment of the disclosure is illustrated. Features similar to the nozzle and cap assembly 10 illustrated in FIG. 1 are denoted with the same reference numeral and a prime (') symbol for clarity. The nozzle and cap assembly 10' of FIG. 5 is similar to the nozzle and cap assembly 10 of FIGS. 1-4, except the nozzle and cap assembly 10' includes a hanger tab 60 disposed at the closed end 36' thereof and extending outwardly from an outer surface thereof. An aperture 62 is formed in the hanger tab 60. The hangar tab 60 is configured for hanging or displaying the dispensing pouch 100 at a store, for example.

In FIG. 6, an exemplary embodiment of the nozzle and cap assembly 10 coupled to the dispensing pouch 100 is shown. The dispensing pouch 100 such as shown and described in U.S. Pat. Appl. Pub. No. 2003/0205584, which is hereby incorporated in its entirety herein, is configured for containing and dispensing confectionery. In application, the nozzle and cap assembly 10 is joined with the dispensing pouch 100 by joining the collar 16 with an open end of the dispensing pouch 100. The nozzle and cap assembly 10 can be joined with the dispensing pouch 100 by heat sealing or gluing to form a leak proof seal therebetween. The nozzle and cap assembly 10' of the embodiment shown in FIG. 5, can be similarly coupled to the dispensing pouch. The dispensing pouch 100 can further include an aperture 102 formed therethrough for hanging the dispensing pouch 100.

During an initial use, the cap 14 is removed from the ring 32 and nozzle 12 by breaking the frangible elements and disengaging the threaded sections 22, 24 of the nozzle 12 from the threaded portions 44 of the cap 14. To dispense or extrude a confectionery from the dispensing pouch 100 through the aperture 30 of the nozzle 12, pressure is applied to the outside of the dispensing pouch 100 by a user. A variety of selected tips, not shown, can threadingly engage with the first threaded section 22 or the second threaded section 24 of the nozzle 12 to create shapes and sizes of extruded confectionery as desired. After extruding confectionery, the selected tip can be removed from the nozzle 12. The cap 14 is then positioned to threadingly engage with the nozzle 12 so that the inner surface of the cap 14 interfaces the rim 31 of the nozzle 12 to hermetically seal the aperture 30 of the nozzle 12 after use. The nozzle 12 and cap 14 cooperate with each other to militate against hardening of the confectionery within the dispensing pouch 100 or nozzle 12 or between the nozzle 12 and the cap 14. If an additional use of the dispensing pouch is desired, the cap 14 can then be removed again by disengaging the threaded sections 22, 24 of the nozzle 12 from the threaded portions 44 of the cap 14.

The nozzle and cap assembly 10, 10' can be formed from any suitable material such as a plastic material by a molding process such as injection molding. However, the nozzle and cap assembly 10, 10' can be formed from any material having properties suitable for assisting in dispensing confectionery and by any process now known or later developed.

The nozzle and cap assemblies 10, 10' of the present disclosure minimize cost and complexity of manufacturing while facilitating an effective seal of the confectionery within the dispensing pouch 100. The nozzles 12, 12' are configured to receive any standard decorating tips as desired, such as Wilton brand decorating tips, DEC-A-CAKE brand decorating tips, TONES BROTHERS brand decorating tips, CAKE MATE brand decorating tips, and BETTY CROCKER brand decorating tips, for example.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, compositions and methods can be made within the scope of the present technology, with substantially similar results.

What is claimed is:

1. A nozzle and cap assembly for a dispensing pouch comprising:

a hollow unitary nozzle terminating in a rim and including a first exterior threaded section and a second exterior threaded section having a different diameter from a diameter of the first exterior threaded section, the nozzle including a radially outwardly extending collar; and a cap receiving the nozzle and having an inner surface interfacing with the rim to seal the nozzle.

2. The nozzle and cap assembly of claim 1, wherein the cap hermetically seals the nozzle.

3. The nozzle and cap assembly of claim 1, wherein the rim of the nozzle is substantially planar.

4. The nozzle and cap assembly of claim 1, wherein the cap includes a threaded portion formed on the inner surface thereof, the threaded portion engaging with at least one of the first exterior threaded section and the second exterior threaded section.

5. The nozzle and cap assembly of claim 1, wherein the cap includes a first annular wall engaging with the first exterior threaded section and a second annular wall engaging with the second exterior threaded section.

6. The nozzle and cap assembly of claim 1, wherein the cap has an open end, a closed end, and an annular protrusion extending from the inner surface of the cap at the closed end, the protrusion interfacing an inner surface of the nozzle.

7. The nozzle and cap assembly of claim 1, wherein the cap has an open end, a closed end, and a lip extending outwardly from the open end.

8. The nozzle and cap assembly of claim 1, wherein the cap includes a hangar tab disposed thereon, the hangar tab having an aperture formed therein.

9. The nozzle and cap assembly of claim 1, further comprising a ring positioned intermediate the cap and the nozzle, the ring having a notch formed therein, and wherein the cap has a tab extending therefrom configured to engage with the notch.

10. A nozzle and cap assembly for a dispensing pouch comprising:

a nozzle including a first end having a radially outwardly extending collar, a second end, and an aperture extending therethrough, the second end having a first threaded portion and a second threaded portion formed on an outer surface thereof, the first second threaded portion having a diameter greater than a diameter of the second first threaded portion, wherein a flange is disposed intermediate the collar and the second threaded portion; and a cap having an open end, a closed end, a first wall disposed adjacent the closed end and releasably engaging with the first threaded portion, and a second wall disposed adjacent the open end and releasably engaging with the second threaded portion, an inner surface of the closed end covering the aperture of the nozzle.

11. The nozzle and cap assembly of claim 10, wherein a substantially planar rim is formed at the second end of the nozzle, the rim interfacing with the inner surface of the closed end of the cap.

12. The nozzle and cap assembly of claim 10, further comprising a ring positioned intermediate the cap and the nozzle, the ring having a notch formed therein.

13. The nozzle and cap assembly of claim 12, wherein the cap includes a lip extending outwardly from the open end thereof and a tab extending from the lip, the tab configured to engage with the notch of the ring.

14. The nozzle and cap assembly of claim 10, wherein the cap has an annular protrusion extending from the inner surface of the closed end, the protrusion interfacing an inner surface of the nozzle.

15. The nozzle and cap assembly of claim 10, wherein the cap includes a hangar tab disposed thereon, the hangar tab having an aperture formed therein.

16. A dispensing pouch assembly comprising:

a dispensing pouch having an opening;

a hollow unitary nozzle in fluid communication with the opening of the dispensing pouch and including a first end and a second end, the first end joined with the dispensing pouch, the second end terminating in a substantially planar rim and having a first exterior threaded section and a second exterior threaded section, the first exterior threaded section having a different diameter from a diameter of the second exterior threaded section; and a cap receiving the nozzle and having an inner surface interfacing with the substantially planar rim to seal the nozzle.

17. The dispensing pouch assembly of claim 16, further comprising a ring positioned intermediate the cap and the nozzle, the ring having a notch formed therein, and wherein the cap has a tab extending therefrom, the tab engaging with the notch.

18. The dispensing pouch assembly of claim 16, wherein at least one of the cap and one of the dispensing pouch includes an aperture formed therein configured for hanging the dispensing pouch assembly.

* * * * *